United States Patent [19]

Cox

[11] 3,995,965

[45] Dec. 7, 1976

[54] ROAD SURFACE DEICING DEVICE

[75] Inventor: Steven M. Cox, Brownsburg, Ind.

[73] Assignee: The Raymond Lee Organization, Inc., New York, N.Y. ; a part interest

[22] Filed: Mar. 31, 1976

[21] Appl. No.: 672,159

[52] U.S. Cl. ..... 404/71; 404/17; 404/79

[51] Int. Cl.[2] ..... E01H 5/10

[58] Field of Search ..... 404/71, 79, 17, 27, 404/72; 49/93

[56] References Cited

UNITED STATES PATENTS

| | | | |
|---|---|---|---|
| 223,784 | 1/1880 | Watson | 404/71 |
| 795,772 | 7/1905 | Janney | 404/71 X |
| 1,349,136 | 8/1920 | Lillard | 404/71 X |
| 1,771,269 | 7/1930 | Musgrave | 404/71 X |
| 2,403,014 | 7/1946 | Nampa | 49/93 X |
| 2,876,326 | 3/1959 | Akmentin | 404/17 X |
| 3,047,701 | 7/1962 | Frungel | 404/17 X |
| 3,377,462 | 4/1968 | Pferschy | 404/71 X |
| 3,680,449 | 8/1972 | Guritz | 404/17 |

*Primary Examiner*—Nile C. Byers, Jr.
*Attorney, Agent, or Firm*—Daniel Jay Tick

[57] ABSTRACT

A heating system includes fluid ducts at the surface of a road and heating fluid for deicing the road surface when circulated through the ducts. A pump device for circulating the heating fluid through the fluid ducts to deice the road surface comprises a fluid pump housed beneath the surface of the road and coupled to the fluid ducts. The fluid pump has a piston and an actuator plate coupled to the piston. The actuator is pivotally mounted at the surface of the road in a manner whereby the weight of a vehicle passing over the actuator plate operates the pump device to circulate the heating fluid through the fluid ducts.

4 Claims, 3 Drawing Figures

ROAD SURFACE DEICING DEVICE

BACKGROUND OF THE INVENTION

The present invention relates to a road surface deicing device.

Objects of the invention are to provide a road surface deicing device of simple structure, which is inexpensive in manufacture, installable with facility and convenience at any desired location in a road surface, and functions efficiently, effectively and reliably to deice the road surface when there is traffic on the road, upon actuation by a vehicle passing thereover.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 2:
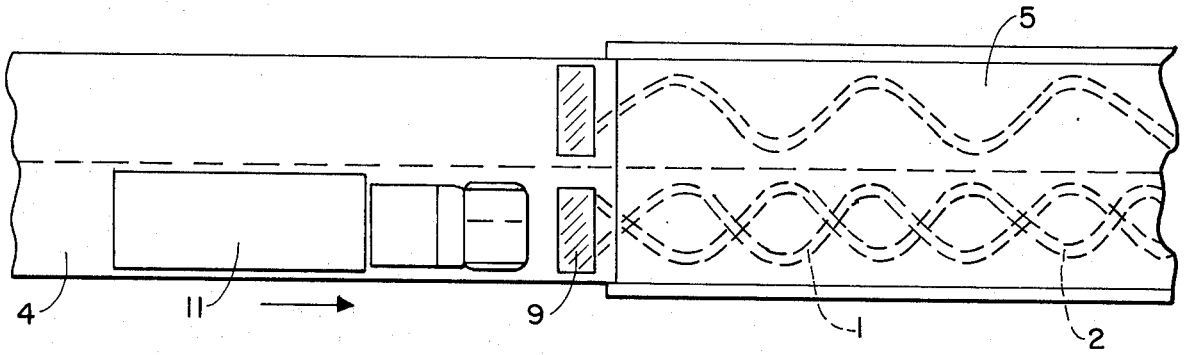
FIG. 2 is another schematic diagram illustrating the positioning of the road surface deicing device of the invention.

The road surface deicing device of the invention comprises fluid ducts 1 and 2 at the surface 3 of a road 4 (FIG. 2).

Figure 1:
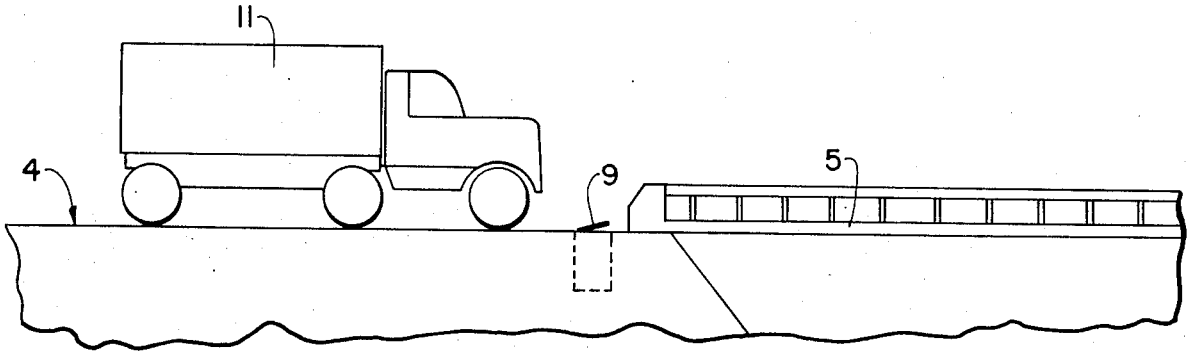
FIG. 1 is a schematic diagram illustrating the positioning of the road surface deicing device of the invention.

A heating system includes the fluid ducts 1 and 2 and heating fluid of any suitable type for deicing the road surface 3 when circulating through the ducts. The heating fluid may comprise boiling water, hot water, steam, chemicals of any suitable type, or the like. The road surface 3 is preferably the surface of a bridge 5 (FIGS. 1 and 2), although it may be any desired surface.

Figure 3:
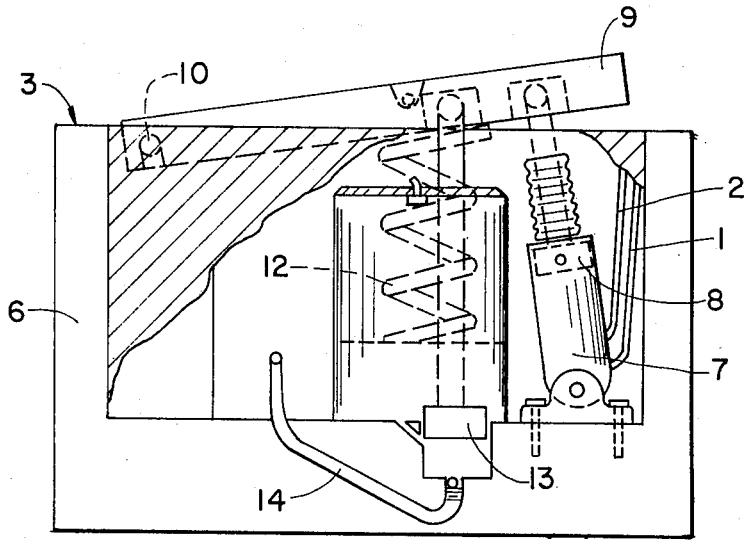
FIG. 3 is a view, partly cutaway, partly in section, and on an enlarged scale, of an embodiment of the pump device of the road surface deicing device of the invention.

In accordance with the invention, a pump device 6, shown in FIG. 3, circulates the heating fluid through the fluid ducts 1 and 2 to deice the road surface 3. The pump device 6 comprises a fluid pump 7 of any suitable type housed beneath the surface of the road 4 and coupled to the fluid ducts 1 and 2. The entire pump device 6 may be housed in a casing placed in a hole dug beneath the surface of the road. The fluid pump 7 has a piston 8 and an actuator plate 9 coupled to said piston. The actuator plate 9 is pivotally mounted at the surface 3 of the road 4 such as, for example, via a pivot pin 10, in a manner whereby the weight of a vehicle 11 (FIGS. 1 and 2) passing over said actuator plate operates the pump device to circulate heating fluid through the fluid ducts.

A helical spring 12 returns the actuator plate 9 to a position of inclination with the surface 3 of the road 4 after passage of a vehicle. As shown in FIG. 3, the spring 12 is positioned between the bottom of the actuator plate 9 and the inside of the housing of the pump device 6.

A water pump 13 is housed beneath the road surface 3 in the casing of the pump device 6 and is coupled to the actuator plate 9 for removing water from the vicinity of the pump device. The water pumped by a water pump 13 may be directed to a drainage or sewer system via a drainage duct 14 (FIG. 3).

The heating fluid is preferably freon gas, which is compressed by the weight of passing vehicles and is circulated through the fluid ducts to de-ice the road surface.

While the invention has been described by means of a specific example and in a specific embodiment, I do not wish to be limited thereto, for obvious modifications will occur to those skilled in the art without departing from the spirit and scope of the invention.

I claim:

1. A road surface deicing device, comprising fluid ducts at the surface of a road;

a heating system including the fluid ducts and heating fluid for deicing the road surface when circulating through the ducts; and pump means for circulating the heating fluid through the fluid ducts to deice the road surface, said pump means comprising a fluid pump housed beneath the surface of the road and coupled to the fluid ducts, said fluid pump having a piston and an actuator plate coupled to the piston, said actuator plate being pivotally mounted at the surface of the road in a manner whereby the weight of a vehicle passing over said actuator plate operates the pump means to circulate the heating fluid through the fluid ducts.

2. A road surface deicing device as claimed in claim 1, further comprising spring means for returning the actuator plate to a position of inclination with the surface of the road after passage of a vehicle.

3. A road surface deicing device as claimed in claim 1, further comprising a water pump housed beneath the road surface and coupled to the actuator plate for removing water from the vicinity of the pump means.

4. A road surface deicing device as claimed in claim 1, wherein the road surface is the surface of a bridge and the actuator plate of the pump means is positioned at an end of the bridge.

* * * * *